US011277693B1

(12) United States Patent
He et al.

(10) Patent No.: US 11,277,693 B1
(45) Date of Patent: Mar. 15, 2022

(54) MICRO SPEAKER UNIT WITH A WATERPROOF EFFECT

(71) Applicant: CONCRAFT HOLDING CO., LTD., Grand Cayman (KY)

(72) Inventors: Si-Si He, New Taipei (TW); Jie-Ru Chen, New Taipei (TW)

(73) Assignee: CONCRAFT HOLDING CO., LTD., Grand Cayman (KY)

( * ) Notice: Subject to any disclaimer, the term of this patent is extended or adjusted under 35 U.S.C. 154(b) by 0 days.

(21) Appl. No.: 17/146,887

(22) Filed: Jan. 12, 2021

(30) Foreign Application Priority Data

Nov. 24, 2020 (TW) ..... 109141492

(51) Int. Cl.
*H04R 9/06* (2006.01)
*H04R 1/02* (2006.01)

(52) U.S. Cl.
CPC ..... *H04R 9/06* (2013.01); *H04R 1/025* (2013.01); *H04R 2400/11* (2013.01)

(58) Field of Classification Search
CPC ..... H04R 9/06; H04R 1/025; H04R 2400/11
USPC ..... 381/398
See application file for complete search history.

(56) References Cited

U.S. PATENT DOCUMENTS

| | | | | |
|---|---|---|---|---|
| 9,363,594 | B2 | 6/2016 | Azmi et al. | |
| 10,129,652 | B2 | 11/2018 | Vieites et al. | |
| 10,225,645 | B1 * | 3/2019 | Lv | H04R 1/02 |
| 2007/0189574 | A1 * | 8/2007 | Suzuki | H04R 1/345 381/396 |
| 2009/0116676 | A1 * | 5/2009 | Welsh | H04R 1/24 381/380 |
| 2017/0006373 | A1 * | 1/2017 | Bruss | H04R 1/2826 |
| 2018/0184198 | A1 * | 6/2018 | Cross | H04R 9/025 |
| 2019/0058933 | A1 * | 2/2019 | Huo | H04R 1/021 |

* cited by examiner

*Primary Examiner* — Sean H Nguyen
(74) *Attorney, Agent, or Firm* — Muncy, Geissler, Olds & Lowe, P.C.

(57) ABSTRACT

The present invention discloses a micro speaker unit with a waterproof effect, including an outer casing which is provided with an accommodation space and a sound hole, and a micro speaker which is installed in the accommodation space. The micro speaker is assembled from a vibrating diaphragm assembly and a magnetic assembly which is inter-assembled with the vibrating diaphragm assembly. The vibrating diaphragm assembly separates the accommodation space into a front chamber and a rear chamber which are not interconnected; whereas, the front chamber is connected with the sound hole. Therefore, water vapor outside the micro speaker unit can be prevented from entering into the rear chamber and the micro speaker by the vibrating diaphragm assembly, thereby improving the waterproof effect of the entire micro speaker unit.

10 Claims, 9 Drawing Sheets

A-A

C-C

MICRO SPEAKER UNIT WITH A WATERPROOF EFFECT

BACKGROUND OF THE INVENTION a) Field of the Invention

The present invention relates to a micro speaker unit, and more particularly to a micro speaker unit, which is still equipped with a good waterproof effect after a micro speaker is installed.

b) Description of the Prior Art

A micro speaker unit is installed in an electronic product to release sound through electroacoustic conversion. When the micro speaker unit is operating, sound holes are needed so that sound can be diffused outward. Therefore, following the demand of waterproof effect to the electronic product, the electronic product itself should be equipped with a good waterproof effect, and the micro speaker unit is also required to have the good waterproof effect to prevent moisture or water vapor outside the electronic product from entering into the electronic product, thereby damaging the electronic product.

In a conventional micro speaker unit, a micro speaker is usually installed in a casing that is formed with a sound hole, so that the micro speaker diffuses sound outward from the sound hole, after going through electroacoustic conversion. To achieve the demand of waterproofness for most of the existing micro speakers (such as a U.S. Pat. No. 10,129,652 or 9,363,594), silicon injection is applied to a periphery of an internal vibrating diaphragm to connect the vibrating diaphragm with a frame. In addition, a surround is formed between the vibrating diaphragm and the frame, so that the vibrating diaphragm can generate amplitude in the center of frame through the surround to drive air to sound through the amplitude. Furthermore, the surround can also prevent moisture or water vapor from entering into the micro speaker effectively.

However, when the micro speaker is installed in the casing, a waterproof ring is normally installed between the micro speaker and the casing to stop moisture or water vapor from passing through a gap formed between the micro speaker and the casing, thereby achieving the request of waterproofness.

Upon installing this kind of micro speaker unit, the waterproof ring is needed to block moisture or water vapor. Therefore, the waterproof effect of the micro speaker unit can be compromised due to an external factor, such as inadvertent assembly in an installation process or damage and deformation of the waterproof ring, thereby shortening the lifetime of use of the micro speaker unit.

Accordingly, how to provide a micro speaker unit that is still equipped with a good waterproof effect after a micro speaker is installed, is an issue to be solved by the present invention.

SUMMARY OF THE INVENTION

A primary object of the present invention is to provide a micro speaker unit, and more particularly to a micro speaker unit, which is still equipped with a good waterproof effect after a micro speaker is installed.

To achieve the abovementioned object, the present invention to provides a micro speaker unit with a waterproof effect, comprising at least an outer casing and a micro speaker. An interior of the outer casing is provided with an accommodation space, and a side of the outer casing is formed at least with a sound hole that is interconnected with the accommodation space. The micro speaker is installed in the accommodation space to separate the accommodation space into a front chamber that is connected with the sound holes, and a rear chamber that is isolated from the front chamber. The micro speaker is formed by a vibrating diaphragm assembly that separates the accommodation space into the front chamber and the rear chamber, and a magnetic assembly that is disposed in the rear chamber and inter-assembled with the vibrating diaphragm assembly. The vibrating diaphragm assembly is installed at an end of the magnetic assembly, including a vibrating diaphragm that is exposed in the front chamber, a frame that surrounds the vibrating diaphragm, and an elastic connector that is formed among the vibrating diaphragm, the frame and the outer casing. The elastic connector is provided with an elastic supporting member which is disposed between the vibrating diaphragm and the frame, an elastic latching member which is disposed between the frame and a first casing, and at least a connecting member which is connected to between the elastic supporting member and the elastic latching member. In addition, the elastic latching member and the connecting member are tightly attached with the outer casing respectively, so that the accommodation space can be separated into the front chamber and the rear chamber through the connecting member and the elastic latching member, thereby forming a non-connected state between the front chamber and the rear chamber.

In an embodiment, the elastic connector on the vibrating diaphragm assembly is integrally formed on the vibrating diaphragm and the frame with a silicon material by injection molding.

In an embodiment, the connecting member of the elastic connector further surrounds a top of the frame and is formed with plural notches, allowing part of the frame to be exposed in the front chamber through the notches.

In an embodiment, the connecting member is further protruded on a surface of the frame facing toward the front chamber.

In an embodiment, the elastic latching member is further disposed at an angle relative to the connecting member, and the outer diameter of the elastic latching member is larger than that of the frame.

In an embodiment, the vibrating diaphragm assembly also includes a voice coil, which is connected with the vibrating diaphragm and is extended toward the magnetic assembly.

In an embodiment, the magnetic assembly also includes a magnet which is disposed in the voice coil, a U-core which is used to support the magnet, and a seat which surrounds the U-core. In addition, the voice coil is disposed between the magnet and the U-core, so that after being excited, the voice coil can drive the vibrating diaphragm to generate amplitude in the front chamber.

In an embodiment, the seat is interconnected with the frame.

In an embodiment, the outer casing is further constituted by a first casing and a second casing which is inter-assembled with the first casing to form the accommodation space. In addition, the sound holes are disposed on a side of the first casing, and the front chamber is formed after the vibrating diaphragm is assembled in the first casing; whereas, the magnetic assembly is disposed in the rear chamber.

In an embodiment, the diameter of the front chamber is smaller than that of the rear chamber.

To enable a further understanding of the said objectives and the technological methods of the invention herein, the brief description of the drawings below is followed by the detailed description of the preferred to embodiments.

DETAILED DESCRIPTION OF THE PREFERRED EMBODIMENTS

Figure 1:
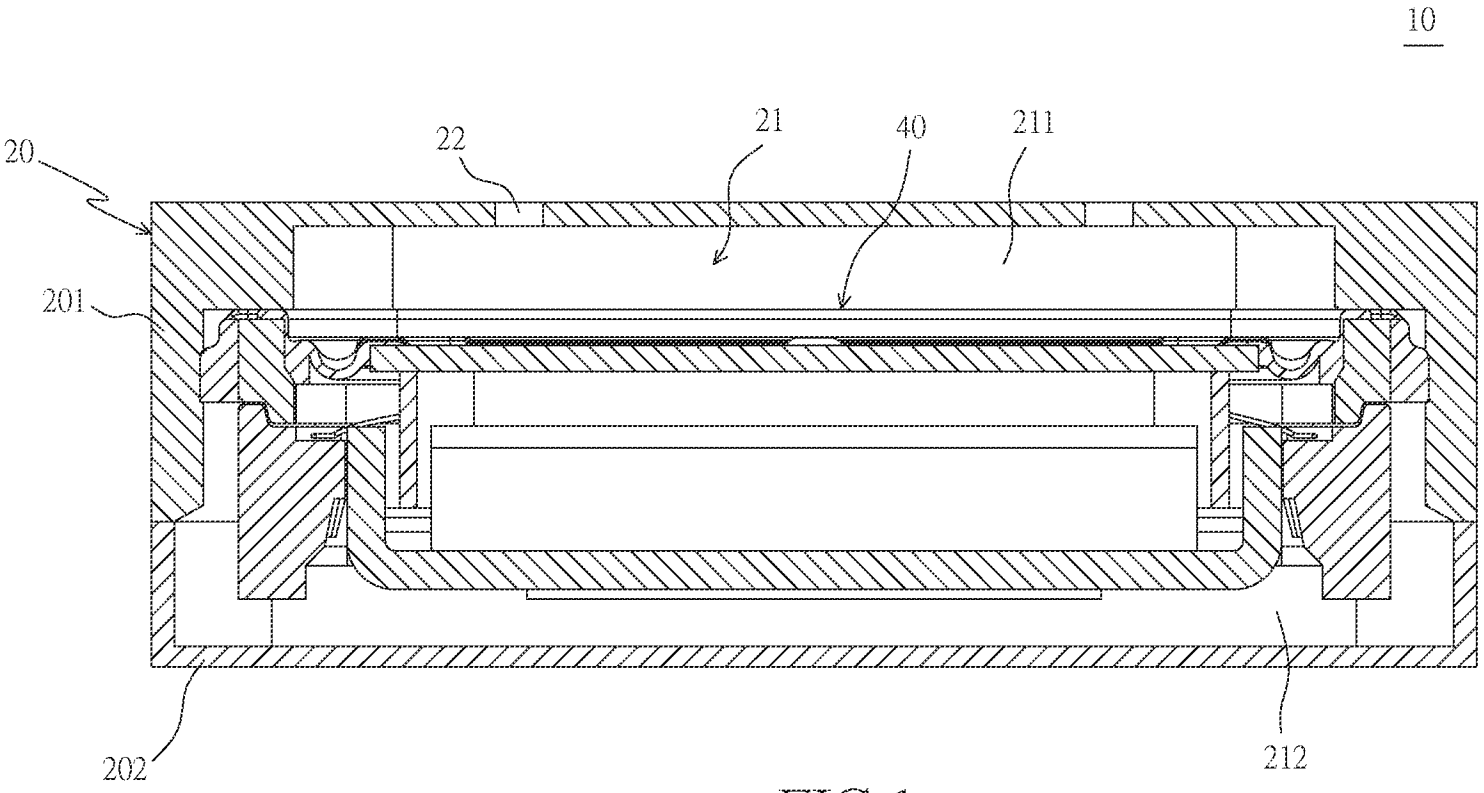
FIG. 1 shows a first cutaway view of a micro speaker unit, according to the present invention.
Figure 2:
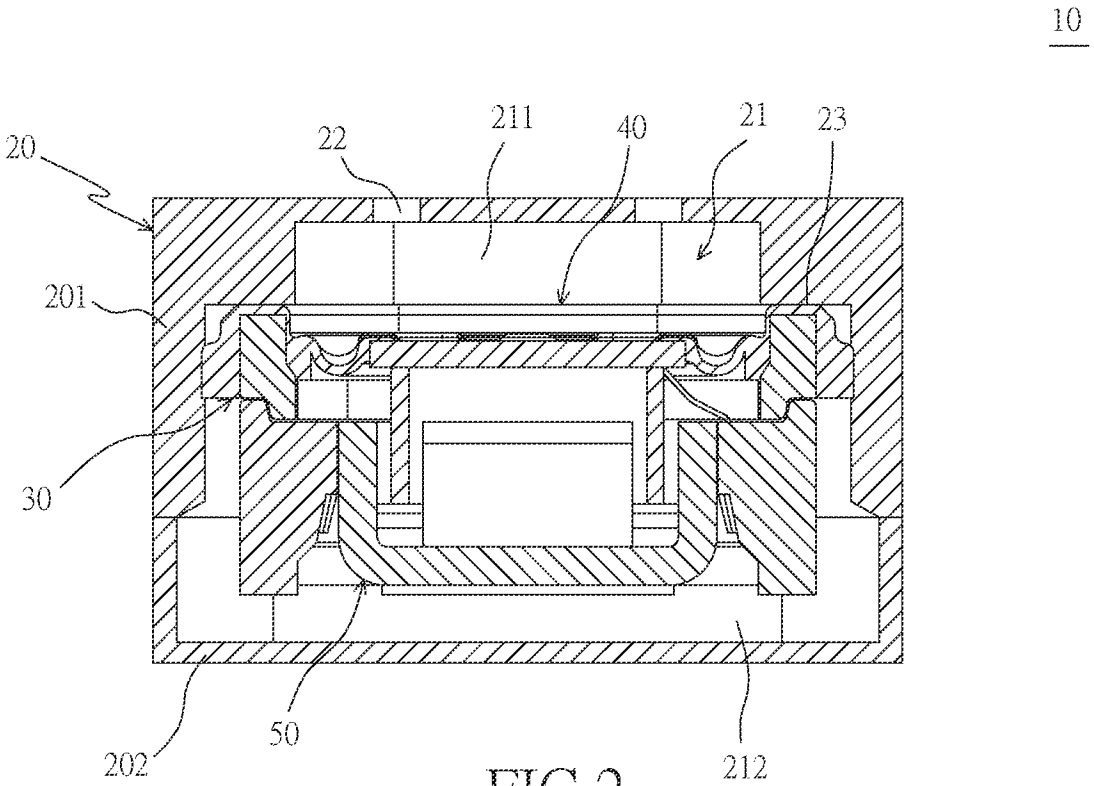
FIG. 2 shows a second cutaway view of the micro speaker unit, according to the present invention.
Figure 3:
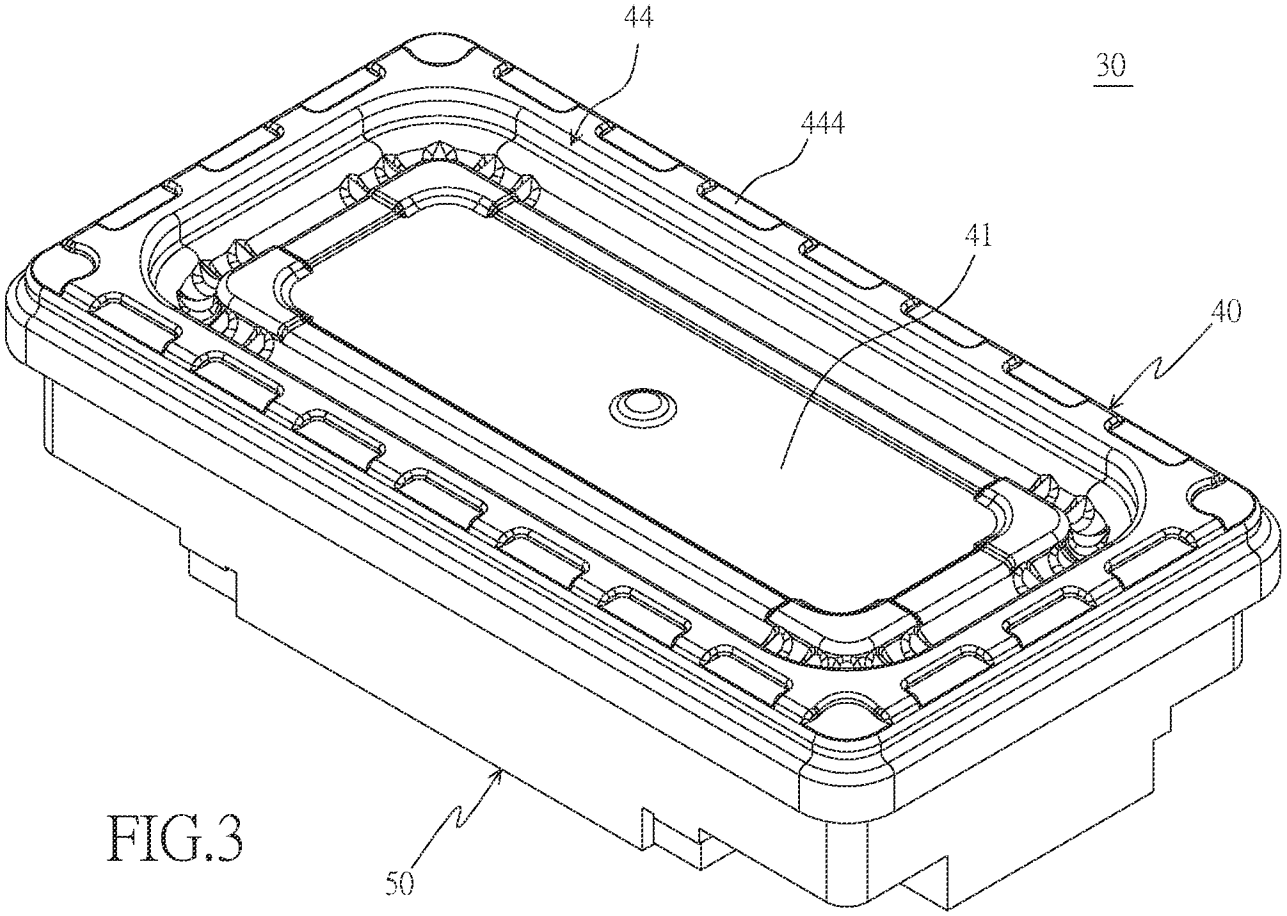
FIG. 3 shows a three-dimensional view of a micro speaker, according to the present invention.
Figure 4:
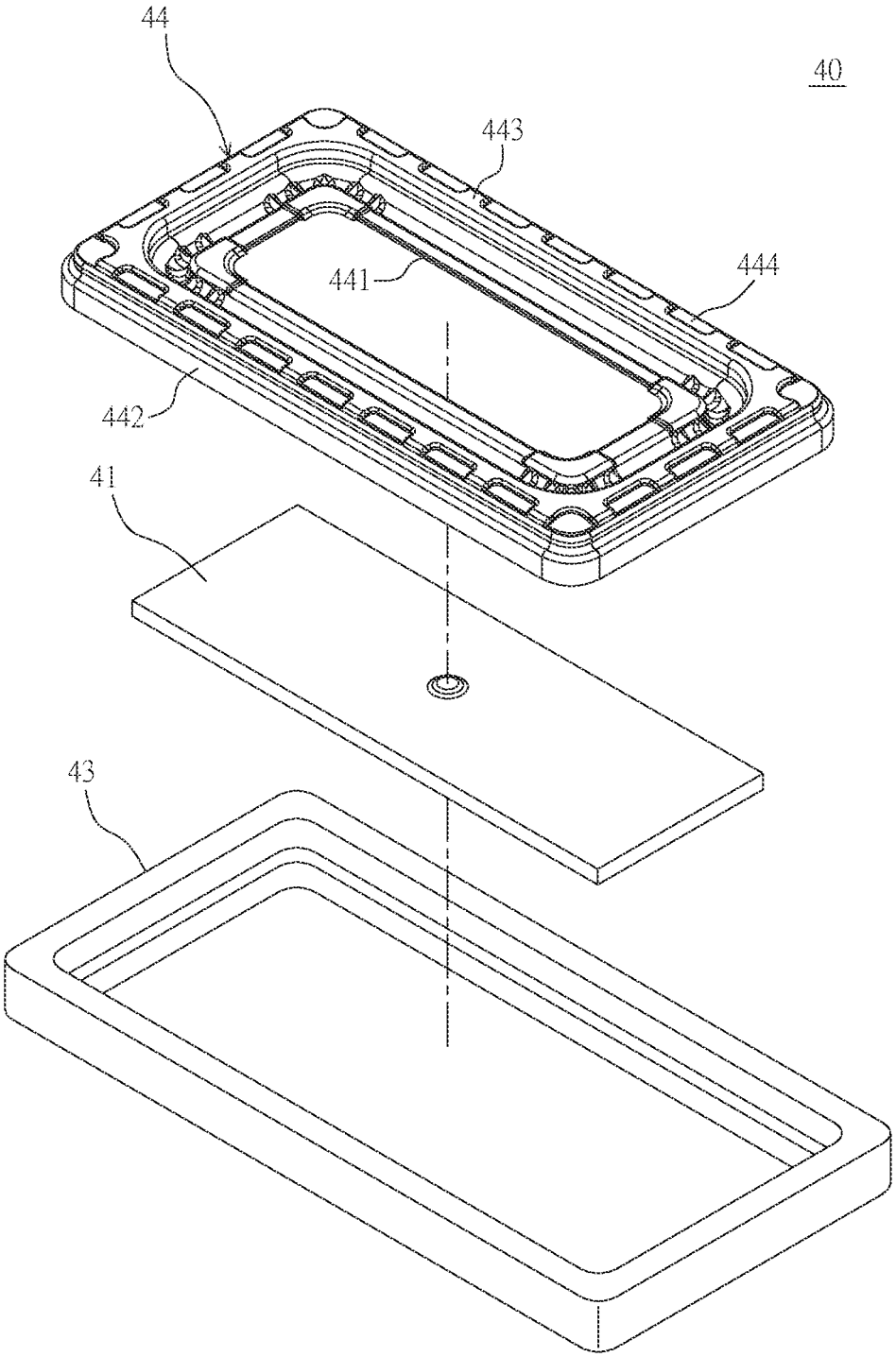
FIG. 4 shows an exploded view of a vibrating diaphragm assembly, according to the present invention.
Figure 5:
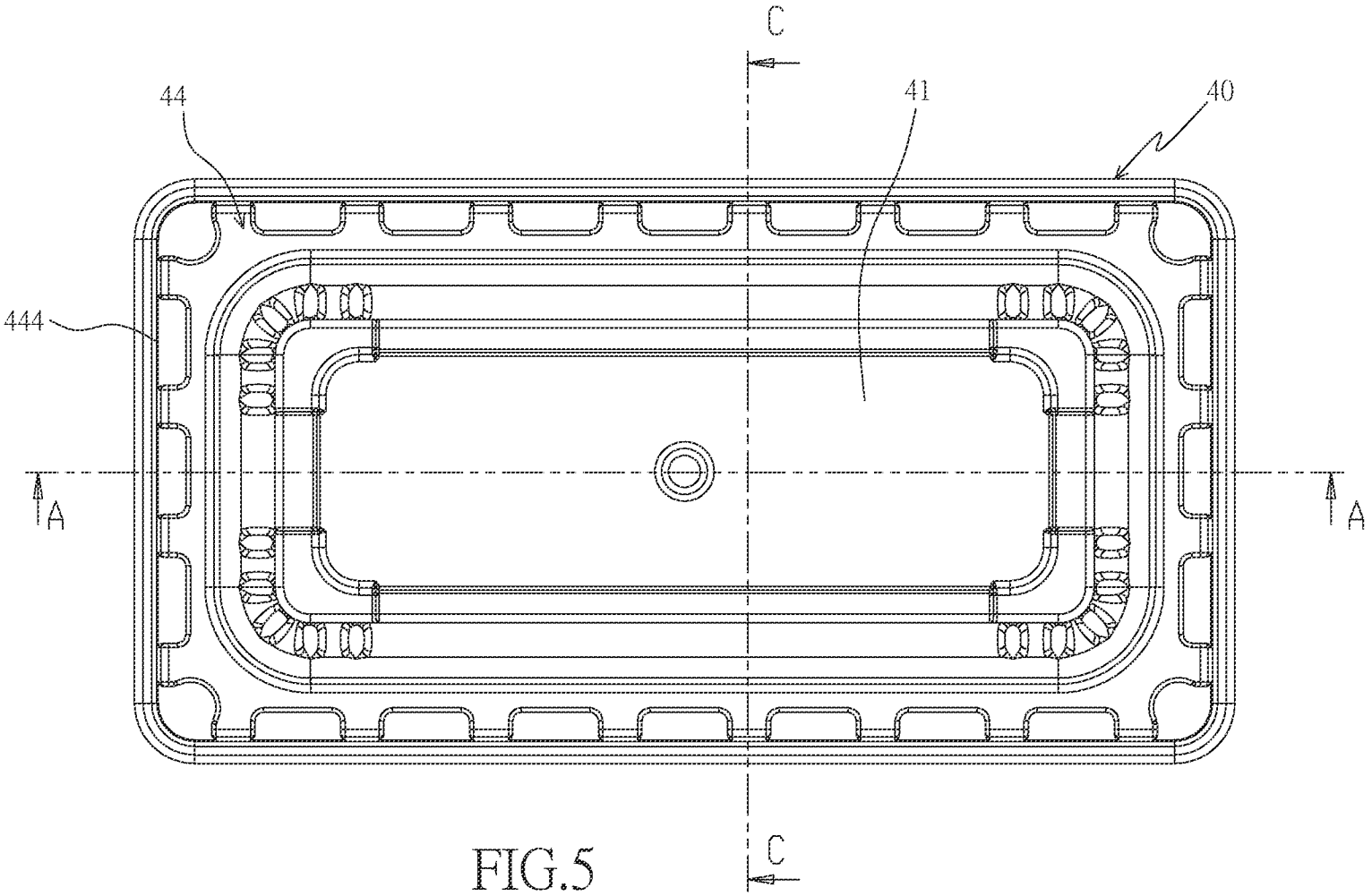
FIG. 5 shows a top view of the micro speaker, according to the present invention.
Figure 6:
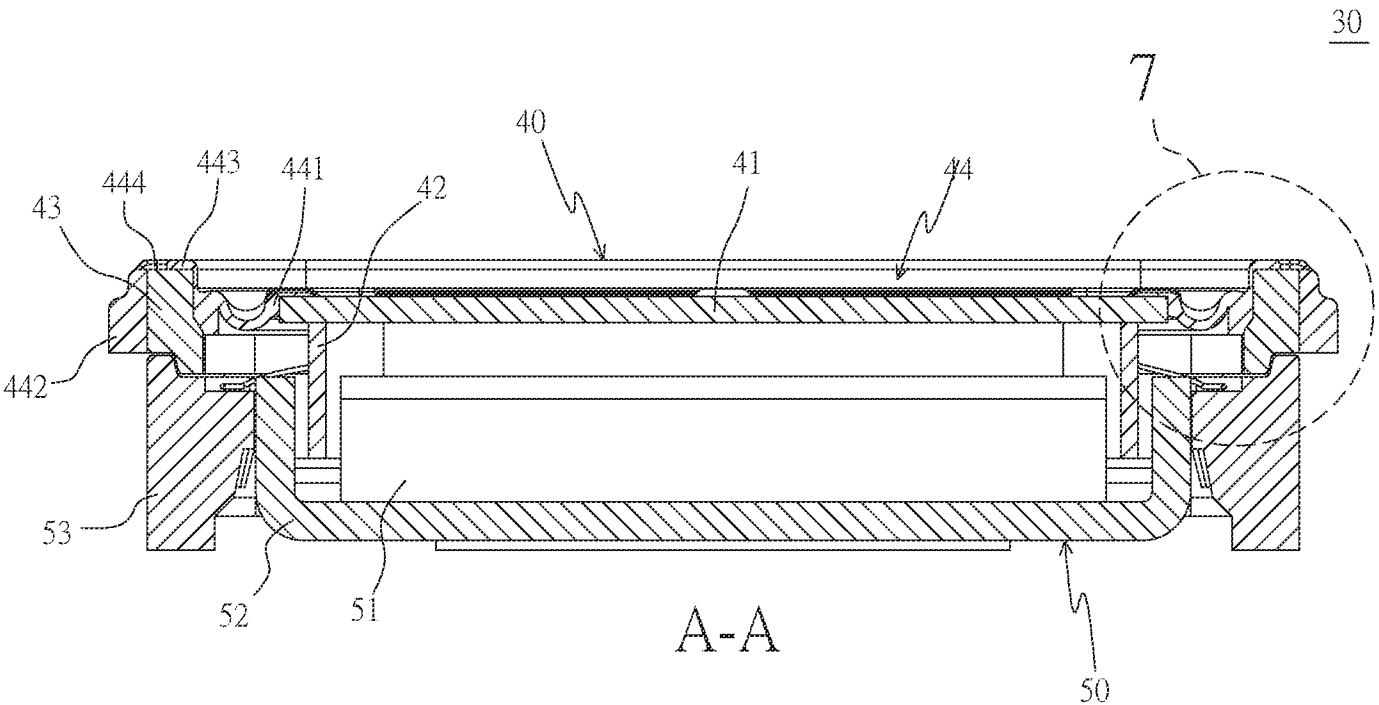
FIG. 6 shows a first cutaway view of the micro speaker, according to the present invention.
Figure 7:
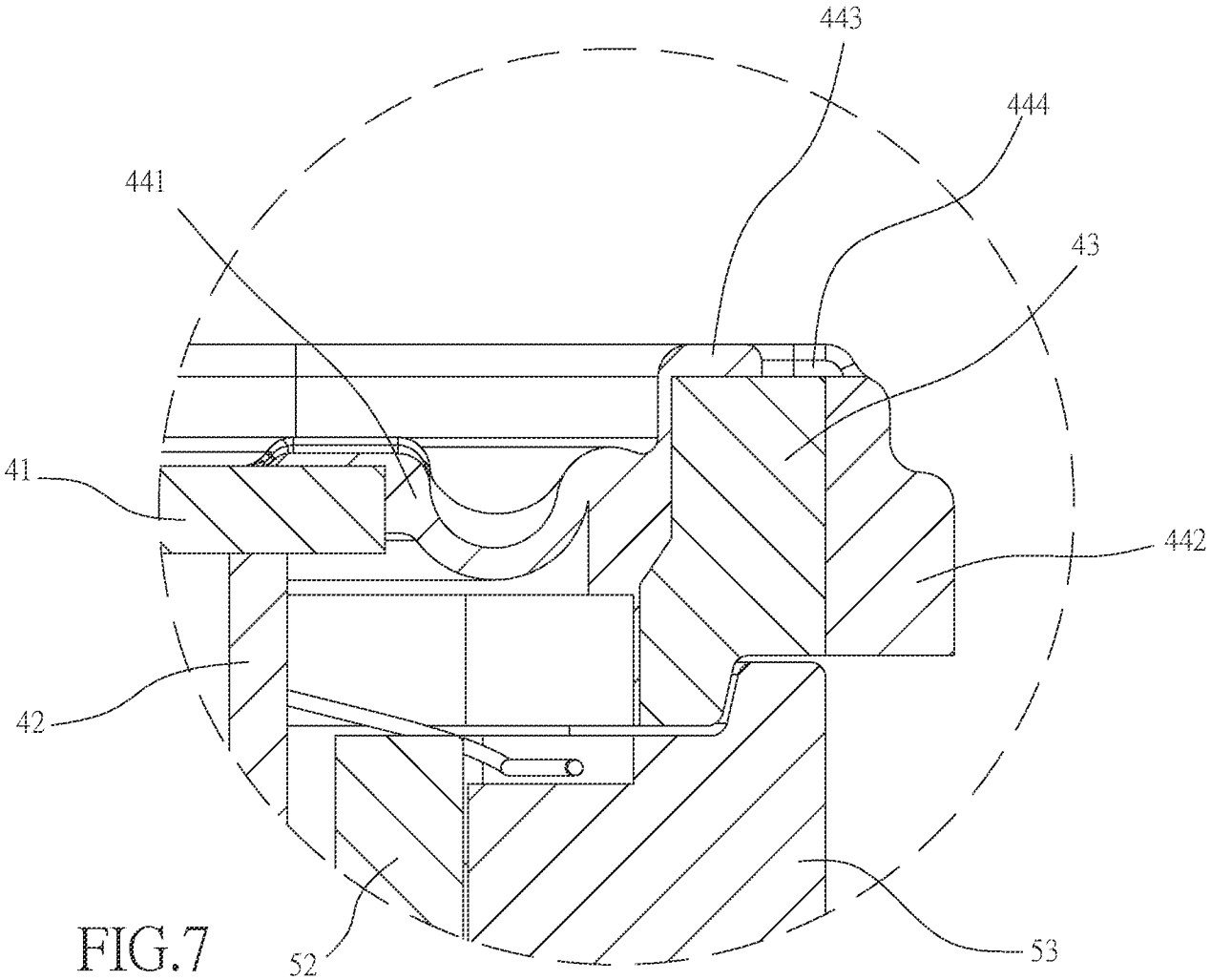
FIG. 7 shows a partially enlarged view of FIG. 6.
Figure 8:
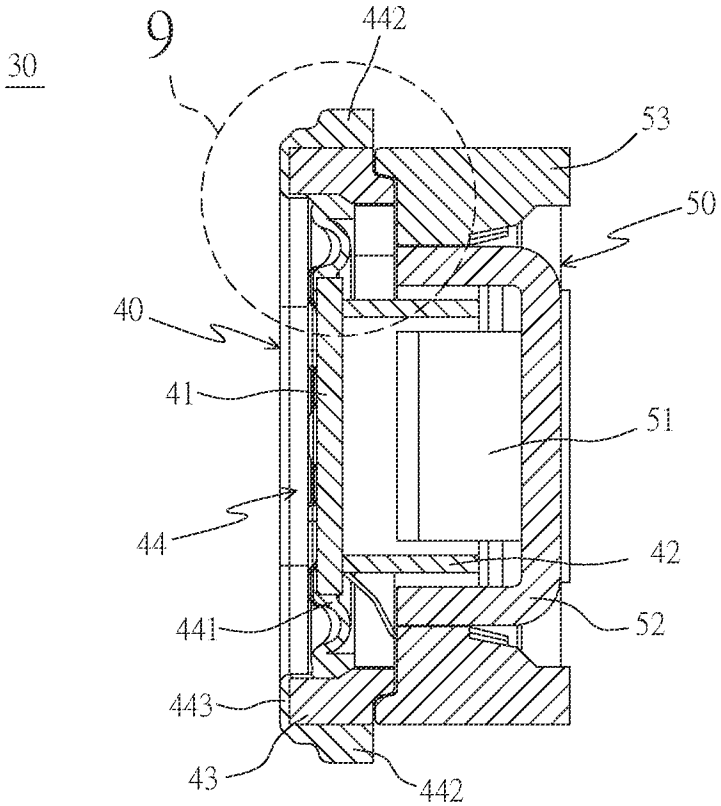
FIG. 8 shows a second cutaway view of the micro speaker, according to the present invention.
Figure 9:
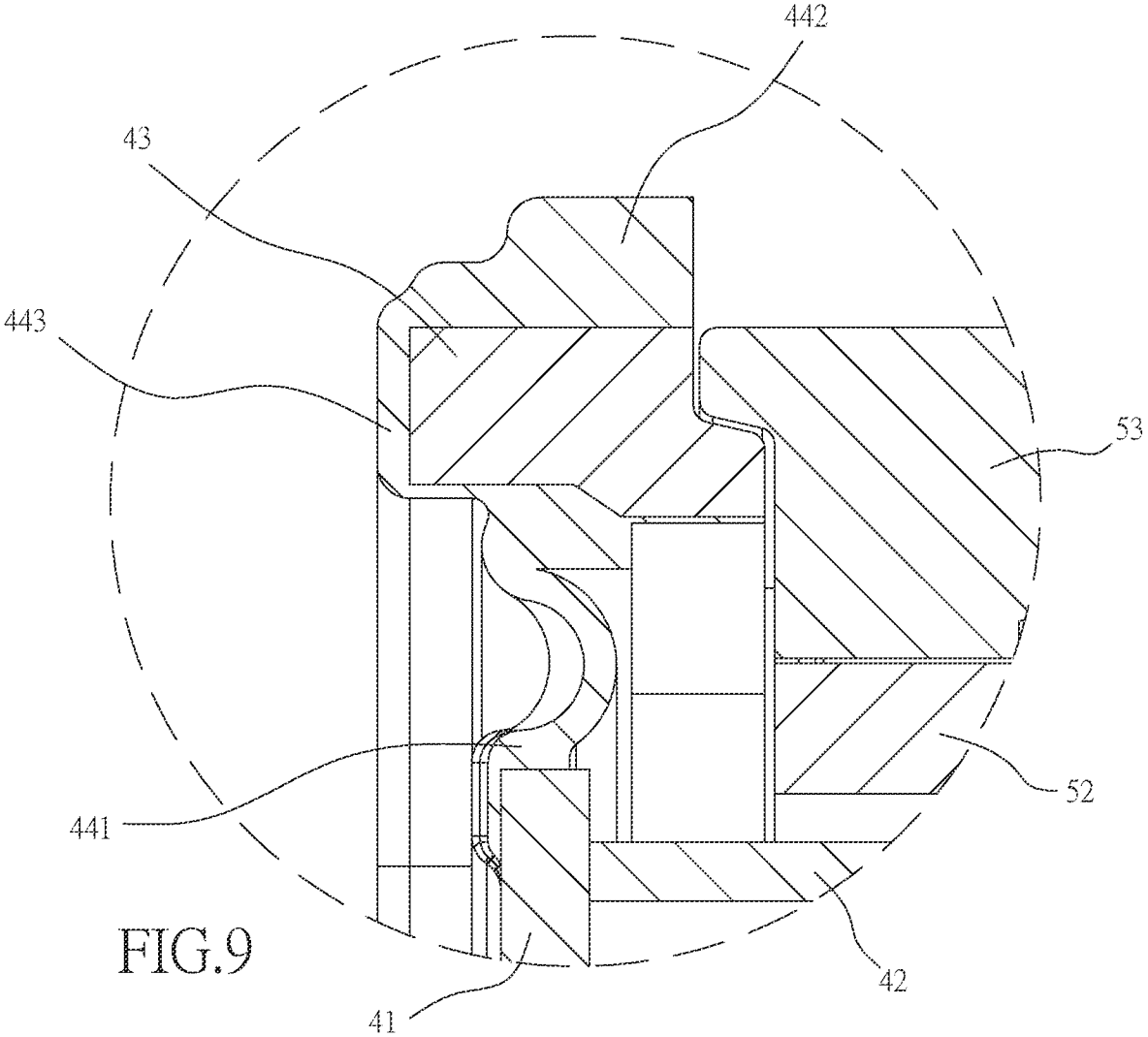
FIG. 9 shows a partially enlarged view of FIG. 8.

Referring to FIG. 1 and FIG. 2, the present invention discloses a micro speaker unit with a waterproof effect. The micro speaker unit 10 comprises an outer casing 20 and a micro speaker 30 which is installed in the outer casing 20.

An interior of the outer casing 20 is provided with an accommodation space 21, and a side wall of the outer casing 20 is provided at least a sound hole 22 which is interconnected with the accommodation space 21. In the present embodiment, the outer casing 20 is further constituted by a first casing 201 and a second casing 202; whereas, the sound holes 22 are disposed on a side wall of the first casing 201, and the first casing 201 and the second casing 202 are inter-assembled to form the accommodation space 21.

Referring to FIG. 1 to FIG. 9, the micro speaker 30 is installed in the accommodation space 21, separating the accommodation space 21 into a front chamber 211 that is connected with the sound holes 22 as well as a rear chamber 212 that is isolated from the front chamber 211, which forms a non-connected state between the front chamber 211 and the rear chamber 212. In addition, the diameter of the front chamber 211 is smaller than that of the rear chamber 212, forming a step surface 23 on an inner wall of the outer casing 20. The micro speaker 30 includes a vibrating diaphragm assembly 40 and a magnetic assembly 50 that is to inter-assembled with the vibrating diaphragm assembly 40.

In the present embodiment, the vibrating diaphragm assembly 40 is installed in the first casing 201 to form the non-connected state between the front chamber 211 and the rear chamber 212. The vibrating diaphragm assembly 40 is assembled from a vibrating diaphragm 41, a voice coil 42, a frame 43 and an elastic connector 44. The vibrating diaphragm 41 is a plate; the frame 43 surrounds the vibrating diaphragm 41 and is isolated from the vibrating diaphragm 41. The voice coil 42 is disposed below the vibrating diaphragm 41, and is extended toward the rear chamber 212. The elastic connector 44 is formed between the frame 43 and the vibrating diaphragm 41, and is extended to an outer side of the frame 43. The elastic connector 44 includes an elastic supporting member 441, an elastic latching member 442 and a connecting member 443. The elastic supporting member 441 is formed between the vibrating diaphragm 41 and the frame 43, and is used to connect the vibrating diaphragm 41 and the frame 43, allowing the vibrating diaphragm 41 to have an amplitude effect where the vibrating diaphragm 41 swings back-and-forth in the frame 43, through the elastic supporting member 441. The elastic latching member 442 is disposed between the frame 43 and the outer casing 20. The connecting to member 443 is disposed above the frame 43, and is used to connect the elastic supporting member 441 and the elastic latching member 442. In addition, the connecting member 443 is protruded on a surface of the frame 43 facing toward the front chamber 211, and is attached with the step surface 23.

The magnetic assembly 50 is assembled below the vibrating diaphragm assembly 40 and is disposed in the rear chamber 212. The magnetic assembly 50 is constituted by a magnet 51, a U-core 52, and a seat 53. The magnet 51 is disposed in the voice coil 42, allowing the voice coil 42 to surround the magnet 51. The U-core 52 is used to carry the magnet 51, and surrounds the voice coil 42, allowing the voice coil 42 to be extended between the magnet 51 and the U-core 52. The seat 53 encloses the U-core 52 and is interconnected with the frame 43, thereby forming the micro speaker 30. After being excited, the voice coil 42 will generate a back-and-forth movement between the magnet 51 and the U-core 52, in an extended direction along the magnet 51. At this moment, the voice coil 42 will drive the vibrating diaphragm 41 to generate the amplitude effect in the center of frame 43, thereby driving air in the front chamber 211 to send out sound through the vibrating diaphragm 41, with the sound being transmitted outward from the sound holes 22.

In the present embodiment, upon forming the vibrating diaphragm assembly 40, the vibrating diaphragm 41 and the frame 43 are first formed, and then, the vibrating diaphragm 41 and the frame 43 are put into a forming space in a mold (not shown in the drawings) at a same time. Next, silicon in a liquid form is injected into the forming space, and the elastic connector 44 can be formed on the vibrating diaphragm 41 and the frame 43 after the silicon material is solidified. Finally, the voice coil 42 is adhered on the vibrating diaphragm 41, forming the vibrating diaphragm assembly 40. The elastic connector 44 formed by silicon is provided with good adherence and good elasticity. Therefore, when the vibrating diaphragm assembly 40 is installed in the accommodation space 21, the installation is mainly performed by attaching the connecting member 443 and the elastic latching member 442 that are formed outside the frame 43 on an inner wall of the outer casing 20 tightly.

In order to form tight attachment between the elastic latching member 442 and the inner wall of the outer casing 20, the present embodiment mainly allows the outer diameter of the elastic latching member 442 to be a little larger than the diameter of the rear chamber 212. Therefore, after the vibrating diaphragm assembly 40 is assembled, the tight attachment effect between the elastic latching member 442 and the inner wall of the outer casing 20 can be formed. In addition, the connecting member 443 can be also attached tightly with the inner wall of the outer casing 20, thereby forming the non-connected state between the front chamber 211 and the rear chamber 212 through the vibrating diaphragm assembly 40. Accordingly, after water vapor outside the outer casing 20 passes through the sound holes 22 to enter into the front chamber 211, the water vapor will not be able to enter into the rear chamber 212 by the blocking of vibrating diaphragm assembly 40, allowing the rear chamber 212 to keep a good air-tight effect. Furthermore, excessive water vapor in the front chamber 211 can pass through the sound holes 22 to exit outward, which can improve the waterproof effect of the micro speaker unit 10 and can also increase the lifetime of use of the micro speaker unit 10 effectively. In addition, as the front chamber 211 is not connected with the rear chamber 212, when the micro speaker unit 10 generates sound, noises from the micro speaker unit 10 can be reduced, thereby improving the tone quality of the micro speaker unit 10.

Moreover, when the connecting member 443 is formed, as the connecting member 443 surrounds the frame 43, the connecting member 443 is formed with at least a notch 444 to reduce the entire weight of the micro speaker unit 10, which exposes part of the surface of the frame 43 to reduce the weight effectively. In addition, the connecting member 443 is disposed at an angle relative to the elastic latching member 442; in the present embodiment, the connecting member 443 is perpendicular to the elastic latching member 442. Besides, by providing plural notches 444 on the connecting member 443, the connecting member 443 and the elastic latching member 442 can be tightly attached together, corresponding to the inner wall and the step surface 23 in the outer casing 20 respectively, with the inner wall being perpendicular to the step surface 23. On the other hand, as the diameter of the front chamber 211 is smaller than that of the rear chamber 212, the connecting member 443 and the elastic latching member 442 can be also tightly attached with the inner wall and the step surface 23 in the outer casing 20, respectively.

Accordingly, in the present invention, the waterproof effect inside the micro speaker 30 is achieved by the elastic supporting member 441. On the other hand, the front chamber 211 is isolated from the rear chamber 212 through the elastic latching member 442 and the connecting member 443, which forms the non-connected state between the front chamber 211 and the rear chamber 212, thereby preventing water vapor from entering into the micro speaker 30 and the rear chamber 212, respectively. Therefore, the waterproof effect can be achieved effectively, and the waterproof effect of the entire micro speaker unit 10 can be improved.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A micro speaker unit with a waterproof effect, comprising:

an outer casing, with an interior of the outer casing being provided with an accommodation space, and a side of the outer casing being formed with sound holes which are interconnected with the accommodation space; and a micro speaker, with the micro speaker being installed in the accommodation space to separate the accommodation space into a front chamber which is connected with the sound holes, as well as a rear chamber which is isolated from the front chamber;

wherein, the micro speaker is assembled from a vibrating diaphragm assembly which separates the accommodation space into the front chamber and the rear chamber, and a magnetic assembly which is disposed in the rear chamber and is inter-assembled with the vibrating diaphragm assembly, with the vibrating diaphragm assembly being installed at an end of the magnetic assembly, and including a vibrating diaphragm which is exposed in the front chamber, a frame which surrounds the vibrating diaphragm, and an elastic connector which is formed among the vibrating diaphragm, the frame and the outer casing; with the elastic connector being provided with an elastic supporting member which is disposed between the vibrating diaphragm and the frame, an elastic latching member which is disposed between the frame and a first casing, and a connecting member which is connected between the elastic supporting member and the elastic latching member; and with the elastic latching member and the connecting member being tightly attached with the outer casing respectively, which separates the accommodation space into the front chamber and the rear chamber through the connecting member and the elastic latching member, thereby forming a non-connected state between the front chamber and the rear chamber.

2. The micro speaker unit with a waterproof effect, according to claim 1, wherein the elastic connector on the vibrating diaphragm assembly is integrally formed on the vibrating diaphragm and the frame with a silicon material by injection molding.

3. The micro speaker unit with a waterproof effect, according to claim 2, wherein the connecting member of the elastic connector further surrounds a top of the frame and is formed with plural notches, allowing part of the frame to be exposed in the front chamber through the notches.

4. The micro speaker unit with a waterproof effect, according to claim 3, wherein the connecting member is further protruded on a surface of the frame facing toward the front chamber.

5. The micro speaker unit with a waterproof effect, according to claim 3, wherein the elastic latching member is further disposed at an angle relative to the connecting member, and the outer diameter of the elastic latching member is larger than that of the frame.

6. The micro speaker unit with a waterproof effect, according to claim 2, wherein the vibrating diaphragm assembly further includes a voice coil that is connected with the vibrating diaphragm and is extended toward the magnetic assembly.

7. The micro speaker unit with a waterproof effect, according to claim 6, wherein the magnetic assembly includes a magnet that is disposed in the voice coil, a U-core that supports the magnet, and a seat that surrounds the U-core; with the voice coil being disposed between the magnet and the U-core, such that the voice coil drives the vibrating diaphragm to generate amplitude in the front chamber, after being excited.

8. The micro speaker unit with a waterproof effect, according to claim 7, wherein the seat is interconnected with the frame.

9. The micro speaker unit with a waterproof effect, according to claim 1, wherein the outer casing is further assembled from a first casing and a second casing which is inter-assembled with the first casing to form the accommodation space, the sound holes are disposed on a side of the first casing, the front chamber is formed after the vibrating diaphragm assembly is assembled in the first casing, and the magnetic assembly is disposed in the rear chamber.

10. The micro speaker unit with a waterproof effect, according to claim 9, wherein the diameter of the front chamber is smaller than that of the rear chamber.

* * * * *